US008528792B2

(12) United States Patent
Ophardt et al.

(10) Patent No.: US 8,528,792 B2
(45) Date of Patent: Sep. 10, 2013

(54) TELESCOPIC PISTON FOR PUMP

(75) Inventors: Heiner Ophardt, Arisdorf (CH); Ali Mirbach, Issum (DE)

(73) Assignee: Gotohti.com Inc., Beamsville (CA)

( * ) Notice: Subject to any disclaimer, the term of this patent is extended or adjusted under 35 U.S.C. 154(b) by 52 days.

(21) Appl. No.: 13/284,222

(22) Filed: Oct. 28, 2011

(65) Prior Publication Data

US 2012/0104051 A1 May 3, 2012

(30) Foreign Application Priority Data

Nov. 1, 2010 (CA) ..... 2719635

(51) Int. Cl.
*B65D 88/54* (2006.01)

(52) U.S. Cl.
USPC ..... 222/321.6; 222/321.7; 222/181.2; 417/550

(58) Field of Classification Search
USPC ..... 91/222, 422; 92/243, 244, 245; 222/409, 321.6, 341, 379, 477, 514, 321.1, 222/321.2, 321.7, 181.2, 181.3, 571; 137/313, 137/854; 417/550
See application file for complete search history.

(56) References Cited

U.S. PATENT DOCUMENTS

| | | | | |
|---|---|---|---|---|
| 5,165,577 | A | 11/1992 | Ophardt | |
| 5,282,552 | A | 2/1994 | Ophardt | |
| 5,676,277 | A | 10/1997 | Ophardt | |
| 5,975,360 | A | 11/1999 | Ophardt | |
| 6,343,724 | B1 | 2/2002 | Ophardt et al. | |
| 6,557,736 | B1 * | 5/2003 | Ophardt | 222/321.9 |
| 7,267,251 | B2 | 9/2007 | Ophardt | |
| RE40,319 | E | 5/2008 | Ophardt et al. | |
| 7,959,037 | B2 | 6/2011 | Ophardt et al. | |
| 8,056,772 | B2 | 11/2011 | Ophardt et al. | |
| 2007/0257064 | A1 | 11/2007 | Ophardt | |
| 2010/0140879 | A1 | 6/2010 | Ophardt et al. | |
| 2011/0014076 | A1 | 1/2011 | Shi et al. | |
| 2011/0132933 | A1 | 6/2011 | Ophardt et al. | |

* cited by examiner

*Primary Examiner* — Paul R Durand
*Assistant Examiner* — Randall Gruby
(74) *Attorney, Agent, or Firm* — Thorpe North & Western LLP

(57) ABSTRACT

A piston pump dispenser in which a volume in a compartment defined inside a piston chamber-forming member and between axially spaced discs on a piston varies with movement of the piston in a cycle of operation due to the piston having a portion between the discs which varies in length.

20 Claims, 11 Drawing Sheets

TELESCOPIC PISTON FOR PUMP

SCOPE OF THE INVENTION

This invention relates generally to a piston for a pump and, more particularly, to an arrangement for a disposable plastic pump for dispensing flowable material.

BACKGROUND OF THE INVENTION

Many dispensers of liquid such as hands soaps, creams, honey, ketchup and mustard and other viscous fluids which dispense fluid from a nozzle leave a drop of liquid at the end of the outlet. This can be a problem that the liquid may harden, as creating an obstruction which reduces the area for fluid flow in future dispensing. The obstruction can result in future dispensing through a small area orifice resulting in spraying in various directions such as onto a wall or user to stain the wall or user or more disadvantageously into the eyes of a user.

Many dispensers of material such as creams and for example liquid honey have the problem of stringing in which an elongate string of fluid hangs from fluid in the outlet and dangles from the outlet after dispensing an allotment of fluid. With passage of time the string may form into a droplet and drop from the outlet giving the appearance that the dispenser is leaking.

Pump assemblies for fluid dispensers are well known. Such pump dispenser includes those invented by the inventor of this present application including those disclosed in U.S. Pat. No. 5,165,577, issued Nov. 24, 1992; U.S. Pat. No. 5,282,552, issued Feb. 6, 1996; U.S. Pat. No. 5,676,277, issued Oct. 14, 1997, U.S. Pat. No. 5,975,360, issued Nov. 2, 1999, and U.S. Pat. No. 7,267,251, issued Sep. 11, 2007, the disclosures of which are incorporated herein by reference. Of these U.S. Pat. No. 7,267,251 teaches a piston pump in which there is, in a charging stroke of a piston moving in a stepped chamber, drawback of fluid from an outlet through which the fluid is dispensed from the chamber in a dispensing stroke due to the provision of stepped chamber as having two portions of different diameter. Such an arrangement while advantageous has the disadvantage of requiring a stepped chamber.

SUMMARY OF THE INVENTION

To at least partially overcome these disadvantages of previously known devices the present invention provides a piston pump dispenser in which a piston having a varying length is provided, such that a volume in a compartment defined inside a piston chamber-forming member and between axially spaced discs on the piston varies with movement of the piston in a cycle of operation.

The present invention is particularly applicable to fluid dispensers which fluid is to be dispensed out of an outlet with the outlet forming an open end of a tubular member. In many applications, the tubular member has its outlet opening downwardly and fluid passing through the tubular member is drawn downwardly by the forces of gravity.

An object of the present invention is to provide a fluid dispenser in which after dispensing fluid out an outlet draws fluid back through the outlet to reduce dripping and/or stringing.

An object of the present invention is to provide a simplified piston pump for dispensing fluid and after dispensing draws back fluid from the outlet of a nozzle from which the fluid has been dispensed.

Accordingly, in one aspect, the present invention provides a pump for dispensing fluids from a reservoir, comprising:

a piston chamber-forming member having an elongate chamber, said chamber having a chamber wall, an outer open end and an inner end in communication with the reservoir;

a one-way valve between the reservoir and the chamber permitting fluid flow through the inner end of the chamber, only from the reservoir to the chamber;

a piston-forming element slidably received in the chamber extending outwardly from the open end thereof;

the piston-forming element having an inner head portion, an outer base portion and a variable length portion intermediate the head portion and the base portion joining the head portion and the base portion, a head disc extending radially outwardly from the head portion, the head disc having an edge portion proximate the chamber wall circumferentially thereabout, the edge portion of the head disc engaging the chamber wall circumferentially thereabout to substantially prevent fluid flow in the chamber past the head disc in an inward direction, the head disc elastically deforming away from the chamber wall to permit fluid flow in the chamber past the head disc in an outward direction, a base disc extending radially outwardly from the stem of the base portion axially outwardly from the head disc, the base disc having an edge portion proximate the chamber wall circumferentially thereabout, the edge portion of the base disc engaging the chamber wall circumferentially thereabout to substantially prevent fluid flow in the chamber past the base disc in an inward direction, the base portion having a central axially extending hollow stem having a central passageway open at an outer end forming an outlet, the passageway extending from the outlet inwardly to an inner end open to the chamber between the head disc and the base disc, the variable length portion having an axial length measured between the head disc and the base disc which is variable between a maximum length and a minimum length, wherein when the variable length portion has the maximum length the variable length portion is in an expanded condition and when the variable length portion has the minimum length the variable length portion is in a compressed condition, the piston-forming element received in the piston chamber-forming member reciprocally coaxially slidable inwardly and outwardly by movement of the base portion in the chamber between a retracted position and an extended position in a cycle of operation to draw fluid from the reservoir and dispense it from the outlet, wherein in movement of the base portion inwardly in the chamber while the length of the variable length portion is greater than the minimum length, resistance to movement of the head disc inwardly in the chamber is sufficient that the length of the variable length portion decreases toward the minimum length before the head disc portion is substantially moved inwardly in the chamber, in movement of the base portion outwardly in the chamber while the length of the variable length portion is less than the maximum length, resistance to movement of the head disc outwardly in the chamber is sufficient that the length of the variable length portion increases toward the maximum length before the head disc portion is substantially moved outwardly in the chamber, and movement of the base portion outwardly in the chamber while the length of the variable length portion increases toward the maximum length draws fluid in the passageway back into the chamber.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
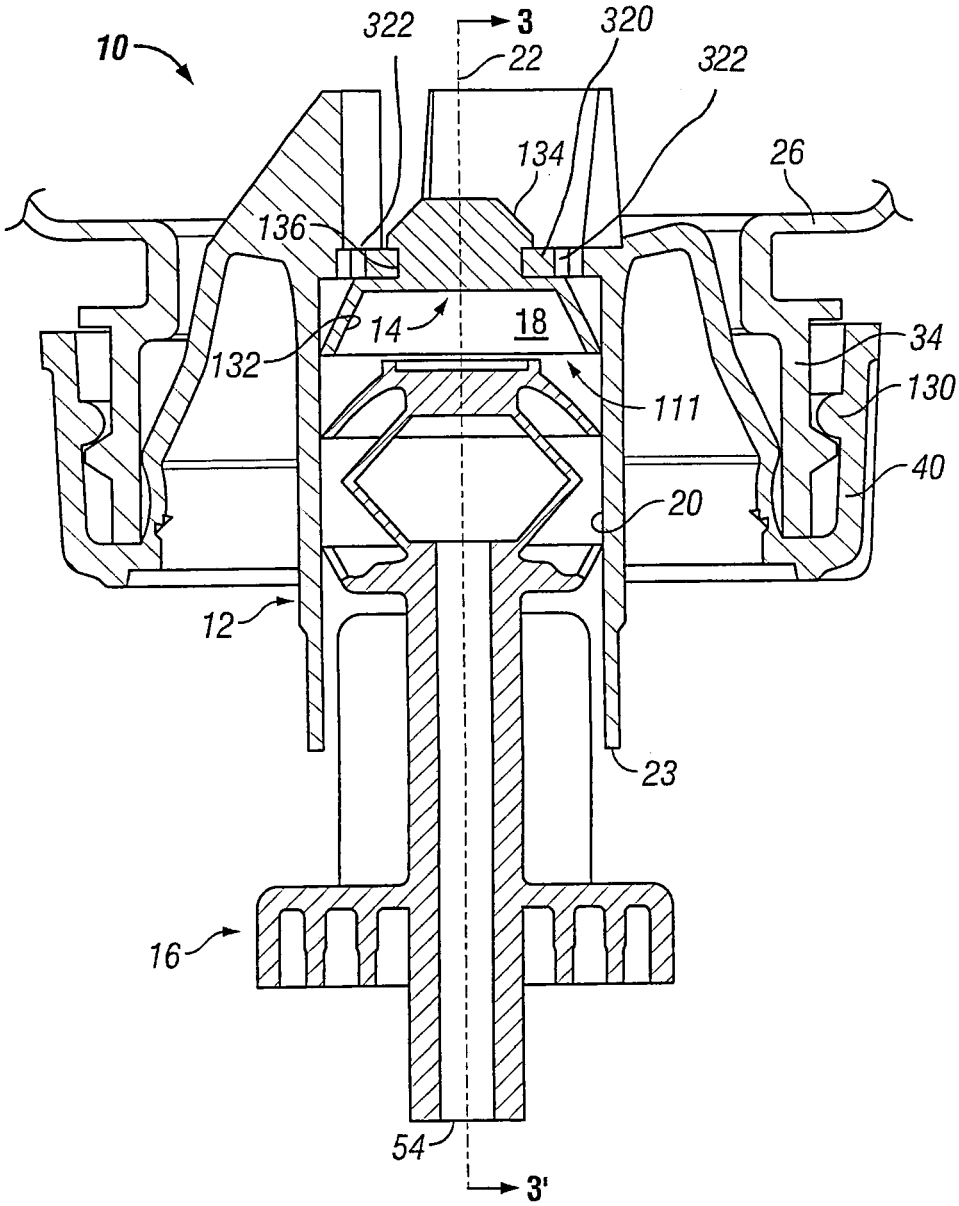
FIG. 1 is a cross-sectional side view of a pump in accordance with a first embodiment of the present invention with a piston in an uncompressed and unexpanded position.

Reference is made first to the pump shown in FIG. 1 comprising a pump assembly 10 secured to a reservoir or container 26 having a threaded neck 34. The pump assembly has a body 12, a one-way valve 14 and a piston 16.

The body 12 provides a cylindrical chamber 18 in which the piston 16 is axially reciprocally slidable in a cycle of operation so as to draw fluid from within the container 26 and dispense it out of an outlet 54. The chamber 18 has a cylindrical chamber wall 20 disposed coaxially about a chamber axis 22.

The piston 16 has a head portion 47, a variable length portion 45 and a base portion 49. The head portion 47 carries a head disc 48. The head disc 48 is a circular resilient flexible disc located at the inwardmost end of the base portion 49 and extending radially therefrom. The head disc 48 is sized to circumferentially abut the inner chamber wall 20 substantially preventing fluid flow therepast inwardly in the chamber 18. The head disc 48 is formed as a thin resilient disc having an elastically deformable edge portion to engage the chamber wall 20. The edge portion extends radially outwardly and in a direction axially outwardly of the chamber 18. The edge portion is adapted to deflect radially inwardly away from the chamber wall 20 to permit fluid flow outwardly in the chamber 18 therepast.

The variable length portion 45 is disposed to bridge between the head portion 47 and the base portion 49 joining them together axially spaced. The variable length portion 45 comprises two elongate members 200, each having an inner end 202 and an outer end 204. The inner end 202 of each elongate member 200 is coupled to the head portion 47. The outer end 204 of each elongate member 200 is coupled to the base portion 49. Each of the elongate members 200 are coupled to the head portion 47 and the base portion 49 in a manner so as to not interfere with the engagement of the head disc 48 and the base disc 50 with the side wall 20 of the chamber.

The base portion 49 is arranged such that the outer ends 204 of the elongate members 200 are coupled to a stem 46 of the base portion 49 radially inwardly from the base disc 50. The head portion 47 is shown to have a centrally extending stem 43 upon which the head disc 48 is mounted. The inner ends 202 of the elongate members 200 are coupled to the stem 43 radially inwardly from the head disc 48. Each elongate member 200 includes an inner beam portion 206 and an outer beam portion 208 joined at a juncture 210. Each inner beam portion 206 thus extends from an inner end 202 to the juncture 210. Each outer beam portion 208 extends from the juncture 210 outwardly to the outer end 204.

Figure 2:
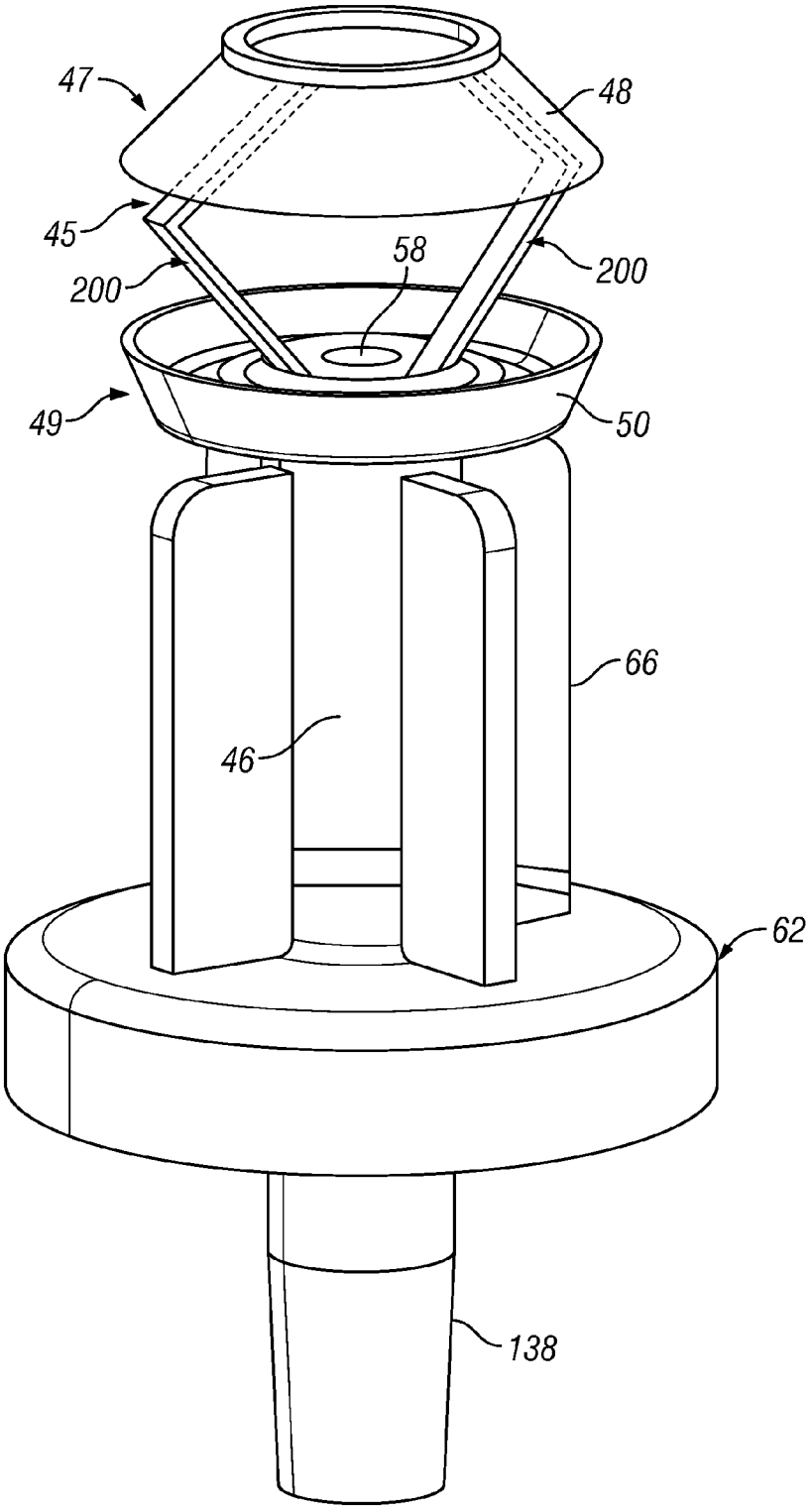
FIG. 2 is a pictorial view of the piston of the pump shown in FIG. 1.
Figure 4:
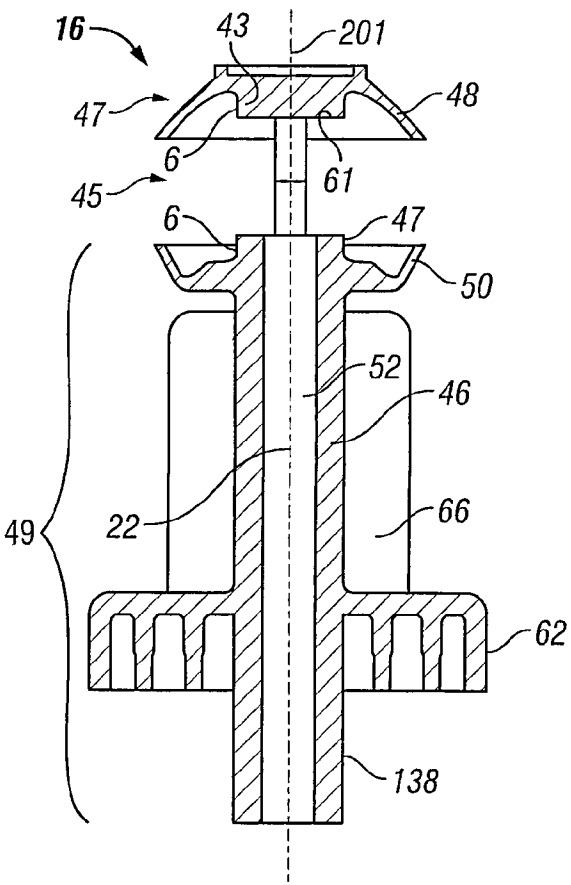
FIG. 4 is a cross-sectional side view of the piston of FIG. 3 along section line 4-4' in FIG. 3.
Figure 3:
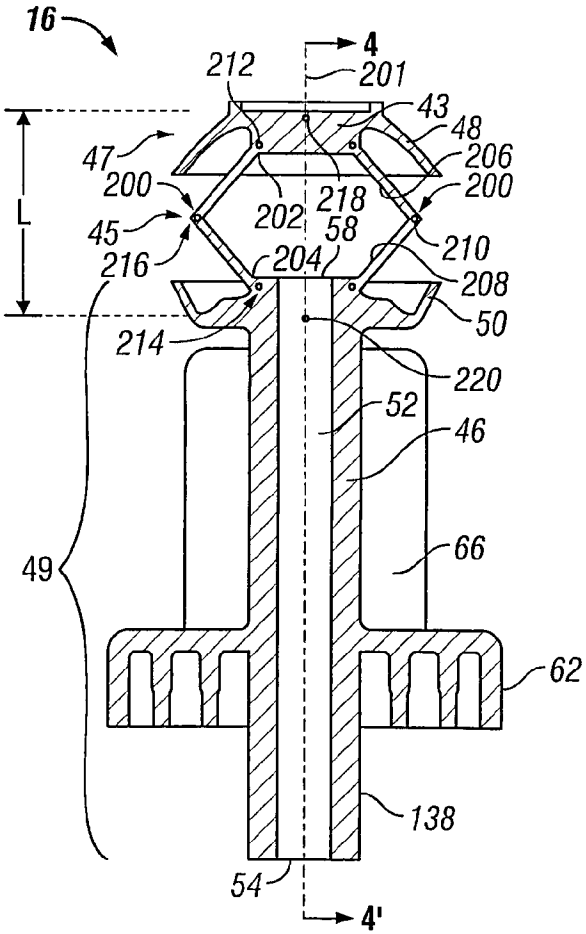
FIG. 3 is a cross-sectional side view of the piston in the same position as in FIG. 1.

As best seen in FIG. 2, each elongate member 200 and its beam portions 206 and 208 have a generally rectangular shape in any cross-section normal the axis 22 with the thickness of each elongate member 200 as seen in FIG. 1 being less than the width of each elongate member as seen in FIG. 4. While not necessary, this rectangular configuration preferably provides some relative rigidity of the elongate members 200 resisting deflection of the elongate members 200 laterally to the left or right as seen in FIG. 4 as contrasted with an ability of the elongate members 200 to deflect laterally to the left or right as seen in FIG. 3. Each of the elongate members 200 has a resiliency by reason of being formed from suitably resilient plastic material. Resiliency of the elongate members 200 is provided in a number of ways as may be appreciated. Firstly, the juncture of each of the inner end 202 with the stem 43 of the head portion 47 may be considered a hinged connection about an inner hinge axis 212 disposed normal to a central axis 201. Similarly, each of the outer ends 204 may be considered to be joined to the stem 46 of the base portion 49 at a hinged connection about an outer hinge axis 214. As well, at the junction 210, each of the inner beam portion 206 and outer beam portion 208 may be considered to be joined at a hinged connection about a mid axis 216. Each of the inner axis 210, the mid axis 216 and the outer axis 214 are parallel to each other. Additionally, each of the inner beam portion 206 and the outer beam portion 208 are capable of deflecting due to their inherent resiliency and the nature of the plastic material from which they are made.

The variable length portion 45 has an axial length defined as a length measured between the head disc 48 and the base disc 50. This axial length is measured along the axis 201 between a center 218 on the head portion 47 and a center 220 of the base portion 49. The axial length is indicated as L on FIG. 3 and is variable between a maximum length and a minimum length due to the ability of the elongate members 200 to deflect.

The piston 16 is shown in each of FIGS. 1 to 4 in an unbiased inherent condition.

Figure 5:
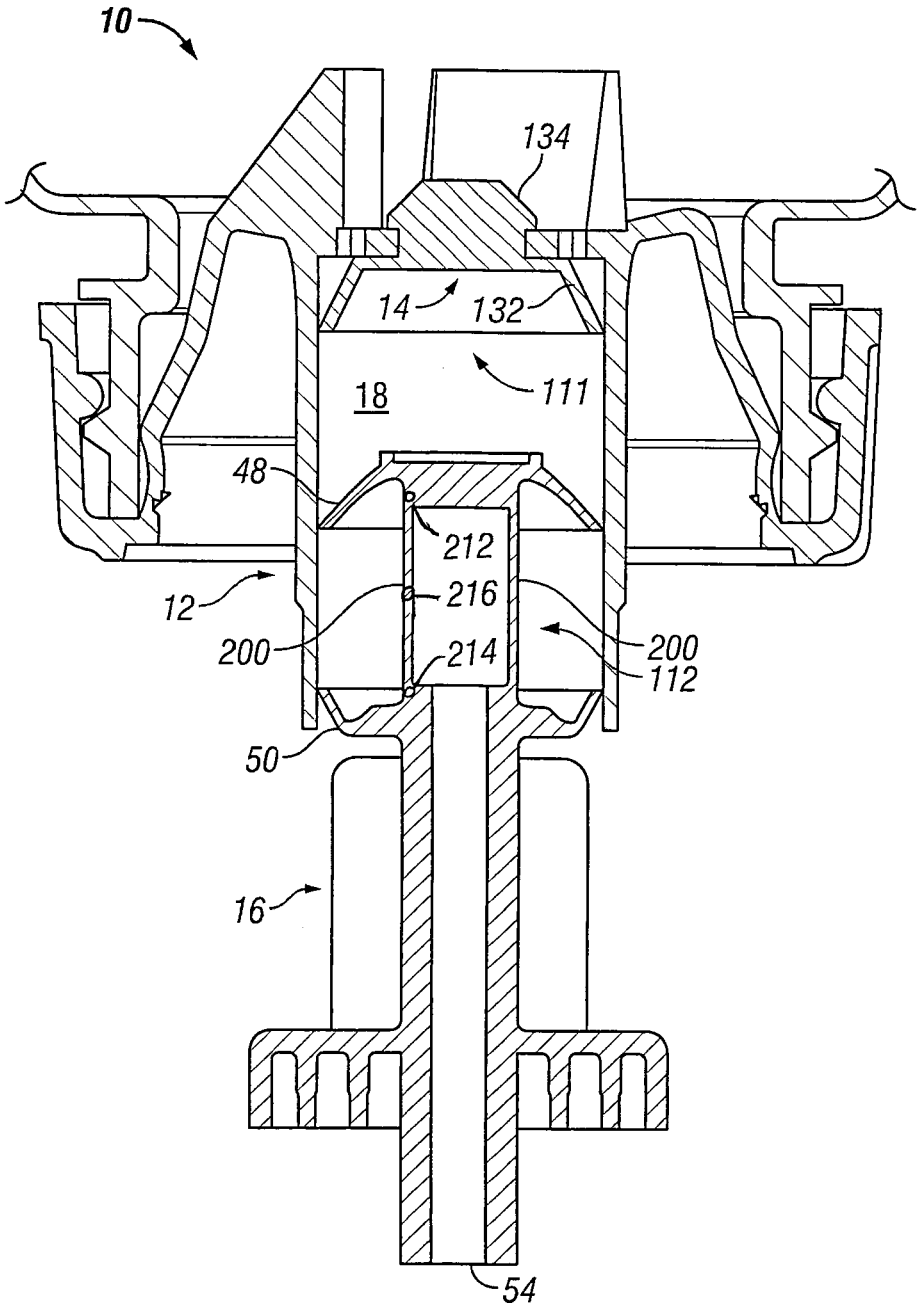
FIGS. 5, 6, 7 and 8 are, respectively, cross-sectional views of the pump of FIG. 1 in an extended and expanded condition, a partially extended and compressed condition, a retracted and compressed condition and a partially retracted and expanded condition.
Figure 6:
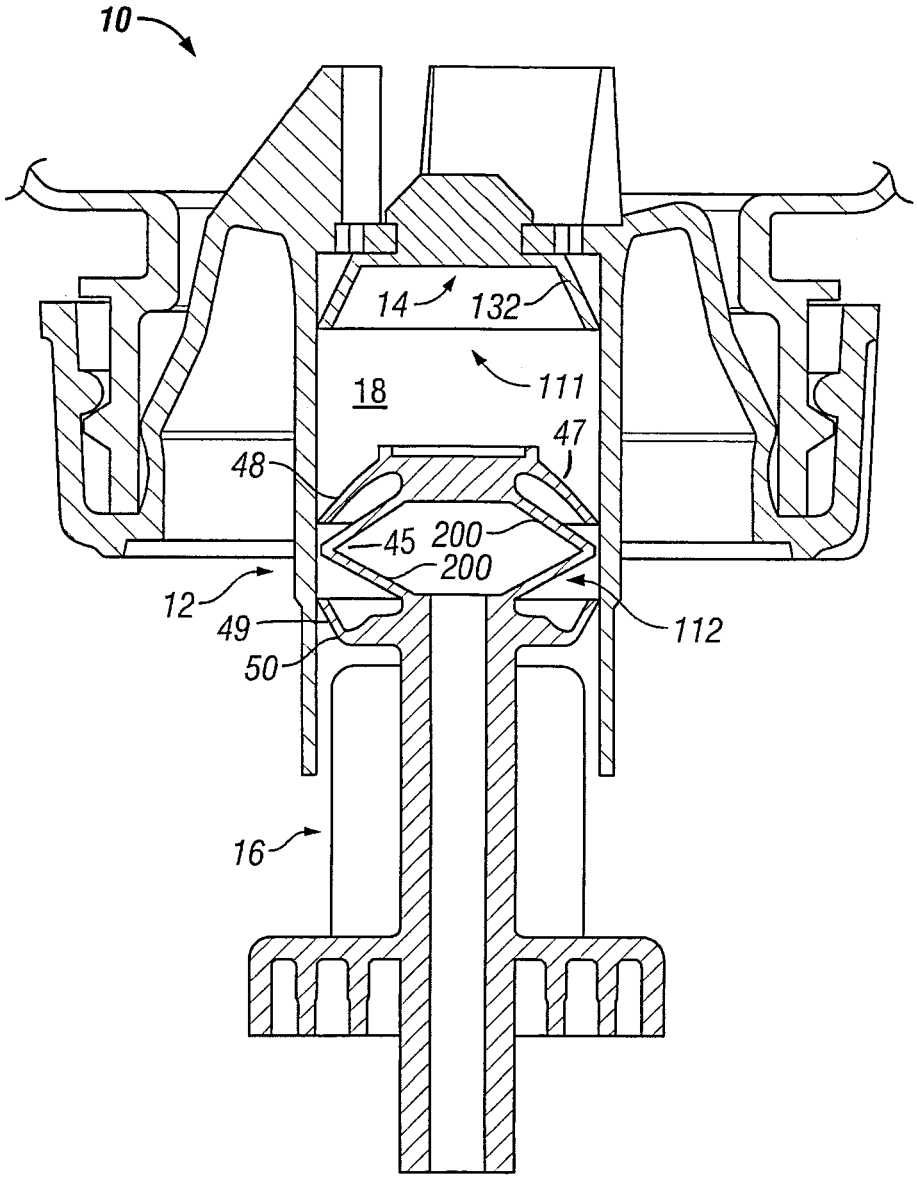
Figure 7:
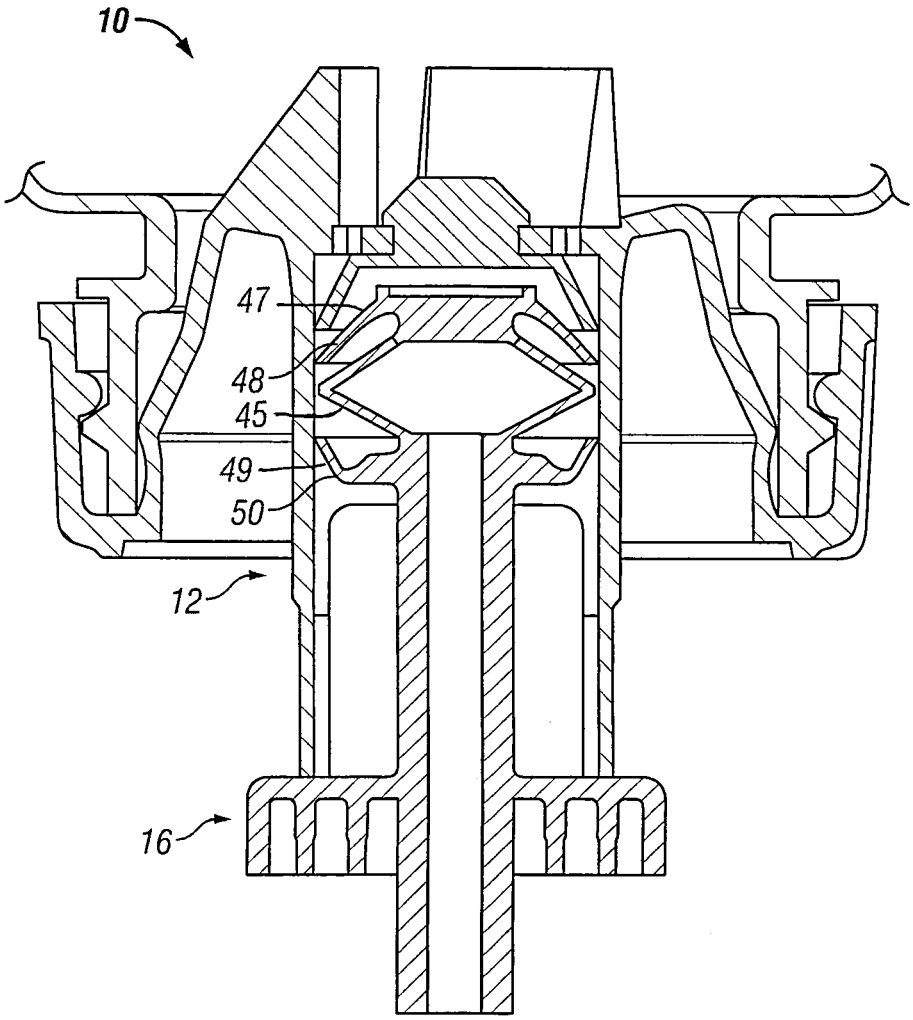
Figure 8:
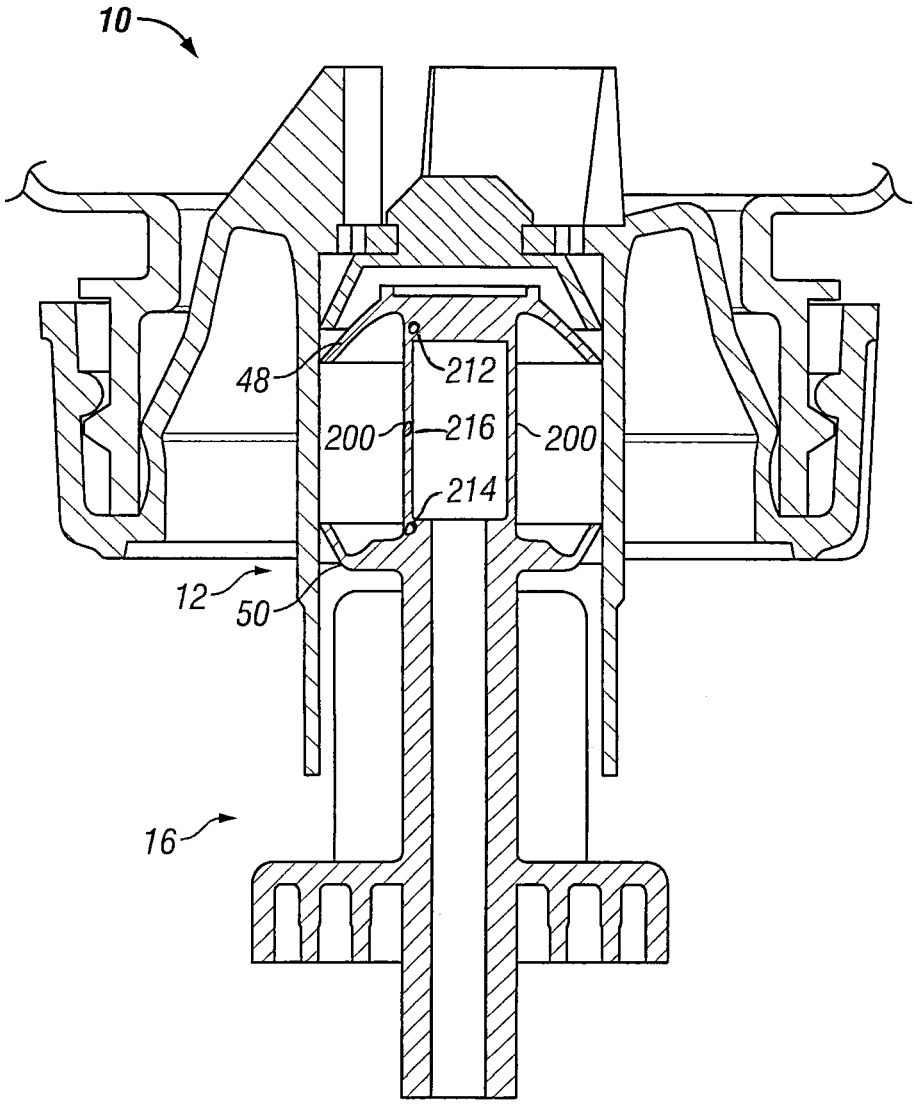

The piston 16 is shown in FIGS. 5, 6, 7 and 8 in use in a cycle of operation of the pump. FIGS. 5 and 8 show the piston 16 within the chamber 18 of the body 12 in an "expanded condition" in which the variable length portion 45 is in its maximum length. This maximum length is achieved when each of the inner axis 212, center axis 216 and outer axis 214 fall within the same flat plane. With movement of the base portion 49 outwardly in the chamber 18, resistance to movement of the head portion 47 and particularly its head disc 48 within the chamber 18 will give rise to tension forces being applied across each of the elongate members 200. The response of the elongate members 200 to such tension force will depend upon the nature and resiliency of each elongate members and the amount of the tension force.

FIGS. 6 and 7 show the piston 16 received in the chamber 18 of the body 12 with the variable length portion 45 in a "compressed condition". With movement of the base portion 49 inwardly in the chamber 18, resistance to inward movement of the head portion 47 and notably resistance to movement of the head disc 48 inwardly in the chamber 18 results in compressive forces being applied to the variable length portion 45 between the base portion 49 and the head portion 47. Such compressive forces cause the elongate members 200 to deflect to reduce the axial length of the variable length portion 45 to the minimum length compressed condition as seen in FIGS. 6 and 7. In this compressed condition, the junctures 210 of the elongate members 200 have been urged radially away from each other, that is, radially outwardly away from each other as seen in FIG. 3 with the junction portions 210 of each elongate member 200 being restricted in radially outward movement by engagement with the chamber wall 20 of the chamber, however, this is not necessary and the compressed condition could be a condition in which the junction portions 210 are not in contact with the chamber wall 20.

In operation of the pump, the relative tension forces and compression forces which may be applied through the variable length portion 45 between the base portion 49 and the head portion 47 will cause the variable length portion 45 to adopt configurations between its maximum length expanded condition and its minimum length compressed condition. The relative resistance of the head portion 47 to sliding within the chamber 18 is affected by many factors including the friction to movement of the disc portion 47 within the chamber 18, inwardly and outwardly, the nature of the fluid in the reservoir having regard to, for example, its viscosity, the temperature, the speed with which the base portion 49 is moved and various other features which will be apparent to a person skilled in the art. A person skilled in the art by simple experimentation can determine suitable configurations for the telescopic member 45 so as to provide for the axial length of the variable length portion to vary between a suitable minimum length and a suitable maximum length in cyclical movement of the piston 16 in a cycle of operation.

The base portion 49 has a stem 46 that carries not only the base disc 50 but also locating webs 66. The base disc 50 is a circular resilient flexible disc located on the stem 46 spaced axially outwardly from the head disc 48. The base disc 50 extends radially outwardly from the stem 46 to circumferentially engage the chamber wall 20 substantially preventing fluid flow therebetween outwardly in the chamber 18. As with the head disc 48, the base disc 50 is preferably formed as thin resilient disc, in effect, having an elastically deformable edge portion to engage the chamber wall 20. The stem 46 has a central passageway 52 extending along the axis 201 of the piston 16 from an inner inlet end 58 located on the stem 46 between the head disc 48 and the base disc 50 to the outlet 54 at the outer end of the head portion 49. The passageway 52 permits fluid communication through the base portion 49 past the base disc 50, between the inlet 58 and the outlet 54. Axially extending webs 66 are provided to extend radially from stem 46 of the base portion 49. These webs 66 engage chamber wall 20 so as to assist in maintaining the base portion 49 axially centered within the chamber 18 when sliding in and out of the chamber 18. The stem 46 comprises a tubular member and can be seen to have the passageway 52 therethrough between the outlet 54 and an inlet 58 with the inlet 58 open to the chamber 18 between the head disc 48 and the base disc 50.

Each of the base portion 49 and the head portion 47 is circular in any in cross-section in FIGS. 3 and 4 normal the axis 201 therethrough. Each of the base portion 49 and the head portion 47 is adapted to be slidably received in chamber 18 coaxially within the chamber 18.

An engagement flange 62 is provided on the stem 46 for engagement to move the base portion 49 inwardly and outwardly. The engagement flange 62 also serves the function of a stopping disc to limit axial inward movement of the piston 16 by engagement with the outer end 23 of the body 12. The stem 46 is shown to extend outwardly from the engagement flange 62 to the discharge outlet 54 as a relatively narrow hollow tube 138 with the passageway 52 coaxially therethrough.

The one-way valve 14 comprises a unitary piece of resilient material having a resilient, flexible, annular rim 132 for engagement with the side wall of the chamber 18. The one-way valve is integrally formed with a shouldering button 134 which is secured in a snap-fit inside an opening 136 in an end wall 320 of the chamber at a central upper end of the chamber 18. Openings 322 are provided through the end wall 320 for fluid flow from the reservoir 26 to the chamber 18.

As seen in FIG. 1, an annular inner compartment 111 is formed inside the chamber 18 between the one-way valve 14 and the head disc 48 and an annular outer compartment 112 is formed inside the chamber 18 between the head disc 48 and the base disc 50. The volume of the annular outer compartment 112 varies with variance of the length of the variable length portion 45 of the piston 16.

The body 12 carries an outer cylindrical portion 40 carrying threads 130 to cooperate with threads formed on the threaded neck 34 of the container 26.

In use, the pump is preferably orientated such that such that the outlet 54 is directed downwardly, however this is not necessary.

The pump operates in a cycle of operation in which the piston 16 is reciprocally moved relative the body 12 inwardly in a retraction stroke and outwardly in a withdrawal stroke.

During movement of the head portion 49 inwardly into the chamber, since fluid is prevented from flowing outwardly past the disc 50, pressure is created in the inner compartment 111 formed in the chamber 18 between the head disc 48 and the one-way valve 14. This pressure urges rim 132 radially outwardly to a closed position abutting the chamber wall 20. As a result of this pressure, head disc 48 deflects at its periphery so as to come out of sealing engagement with the chamber walls 20 and permit fluid to flow outwardly past head disc 48 into the annular outer compartment 112 between the head disc 48 and the sealing disc 50 and hence out of chamber 18 via the passageway 52.

During a withdrawal stroke in which the piston 16 is moved outwardly from the chamber 18, the withdrawal of the piston causes the one-way valve 14 to open with fluid to flow past annular rim 132 which is deflected radially inwardly into the inner compartment 111 in the chamber 18. In the withdrawal stroke, head disc 48 remains substantially undeflected and assists in creating a vacuum in the inner compartment 111 to deflect rim 132 and draw fluid past rim 132.

The head disc 48, on one hand, substantially prevents flow inwardly therepast in the withdrawal stroke and, on the other hand, deforms to permit flow outwardly therepast in the retraction stroke. The head disc 48 shown facilitates this by being formed as a thin resilient disc, in effect, having an elastically deformable edge portion near chamber wall 20.

When not deformed, head disc 48 abuts the chamber wall 20 to form a substantially fluid impermeable seal. When deformed, as by its edge portion being bent away from wall 20, fluid may flow outwardly past the head disc. Head disc 48 is deformed when the pressure differential across it, that is, when the pressure on the upstream side is greater in the inner compartment 111 than the pressure on the downstream side in the outer compartment 112 by an amount greater than the maximum pressure differential which the edge portion of the head disc can withstand without deflecting. When this pressure differential is sufficiently large, the edge portion of the head disc deforms and fluid flows outwardly therepast. When the pressure differential reduces to less than a given pressure differential, the head disc returns to its original inherent shape substantially forming a seal with the wall 20.

FIGS. 5 to 8 which show different conditions the variable length portion 45 assumes in a cycle of operation. In this cycle of operation, the base portion 49 is moved in a retraction stroke from a fully extended position as seen in FIG. 5 to a fully retracted position as seen in FIG. 7. In a withdrawal stroke, the base portion 49 is moved from the fully retracted position of FIG. 7 to the fully extended position shown in FIG. 5.

FIG. 5 illustrates the piston 16 with the base portion 49 in the fully retracted condition and the variable length portion 45 in an expanded condition, that is, with the variable length portion 45 at its maximum length. In this extended and expanded condition of FIG. 5, the outer compartment 112 formed in the chamber 18 between the head disc 48 and base disc 49 is at a maximum volume. From the extended and expanded in condition of FIG. 5, the base portion 49 is moved inwardly in a retraction stroke to assume the condition of FIG. 6 in which the variable length portion 45 is a compressed condition. On the base portion 49 moving inwardly in the chamber 18 from the position of FIG. 5, while the length of the variable length portion 45 is greater than its minimum length, resistance to movement of the head portion 47 and its head disc 48 inwardly in the chamber 18 is sufficient that the length of the variable length portion 45 decreases toward its minimum length as shown in FIG. 6 before the head portion 47 is moved inwardly in the chamber 18. Thus, in movement of the base portion 49 inwardly from the position of FIG. 5, compressive forces will be applied to the variable length portion 45 which forces will reduce the length of the variable length portion 45 until the compressive transferred by the variable length portion 45 are greater than the resistance to movement of the head portion 47 inwardly in the chamber. The compressive forces may be developed such that the variable length portion substantially decreases to its minimum length before the head portion 47 is substantially moved inwardly.

From the position shown in FIG. 6, with the variable length portion in the compressed condition, further inward movement of the base portion 49 in the retraction stroke moves the piston 16 with the variable length portion maintained in the compressed condition inwardly to the position of FIG. 7 in which the base portion 49 is fully retracted and the variable length portion 45 is compressed. FIG. 7 thus represents a retracted and compressed condition of the piston 16.

From the position of FIG. 7, in a withdrawal stroke, the base portion 49 is moved outwardly in the chamber. In movement of the base portion 49 from the position of FIG. 7 to the position of FIG. 8, while the length of the variable length portion 45 is less than the maximum length, resistance to movement of the head portion 47 and therefore its head disc 48 outwardly in the chamber 18 is sufficient that the length of the variable length portion 45 increases toward the maximum length before the head portion is moved outwardly in the chamber 18. In this regard, in moving from the position of FIG. 7 to the position of FIG. 8, outward movement of the base portion 49 applies tension forces to the variable length portion 45. These tension forces will act on the variable length portion 45 expanding the variable length portion 45 until such time as the tension forces which are transferred by the variable length portion 49 from the base portion 49 the head portion 47 are greater than the resistance of the head portion for movement outwardly in the chamber. The tension forces may be developed such that the variable length portion substantially increases to its maximum length before the head portion 47 is substantially moved outwardly.

From the position of FIG. 8, the withdrawal stroke is complete by movement to the position of FIG. 5. In moving from the position of FIG. 8 to the position of FIG. 5, the variable length portion 45 is maintained in the expanded condition with the variable length portion 45 at its maximum length and tension forces caused by movement of the base portion 49 are transferred via the variable length portion 45 to the head portion 47.

In a cycle of operation in moving from the position of FIG. 5 to the position of FIG. 6, the volume of the outer compartment 112 reduces and hence fluid is discharged from the outer compartment 112 through the passageway 52 out the outlet 54 by reason of fluid within the outer compartment 112 being prevented from passing inwardly past the head disc 48 and being prevented from passing outwardly past the base disc 50. In moving from the position of FIG. 6 to the position of FIG. 7, pressure is created within the inner compartment 111 which closes the one-way valve 14. Fluid within the inner compartment 111 becomes compressed by movement of the head disc 48 inwardly. Such pressure causes the deformable edge portion of the head disc 48 to deflect away from the chamber wall 18 thus permitting flow of fluid from the inner compartment 111 into the outer compartment 112. Since the volume of the outer compartment 112 remains the same in the compressed condition, any fluid which is passed outwardly past the head disc 48 causes fluid within the outer compartment 112 to be dispensed through the passageway 52 out from the outlet 54.

In movement from the position of FIG. 7 to the position of FIG. 8, the volume of the outer compartment 112 increases. This increase in volume of the outer compartment 112 causes a drawback of fluid in the passageway 52 from the outlet 54 back into the outer compartment 112. This drawback may not only be a drawback of fluid in the passageway but also possibly of any air existing in the passageway.

To facilitate drawback of fluid, the relative nature of the head disc 48 and the base disc 50 and the engagement of each with the chamber wall 20 are preferably selected such that vacuum created within the outer compartment 112 will drawback fluid from the passageway 54 rather than deflect the head disc 48 to draw liquid from the inner compartment 111 past the head disc 48 into the outer compartment 112, or, deflect the base disc 50 to draw atmospheric air between the base disc 50 and the chamber wall 20.

In movement from the position of FIG. 8 to the position of FIG. 7, the volume in the outer compartment 112 is maintained constant with the variable length portion 45 in the expanded condition, however, movement of the head disc 48 outwardly increases the volume in the inner compartment 111 thus drawing fluid from the reservoir inwardly past the one-way valve 14 into the inner compartment 111.

The drawback pump in accordance with the present invention may be used in manually operated dispensers such as those in which, for example, the piston 16 is moved manually as by a user engaging an actuator such as a lever which urges the piston 16 either outwardly or inwardly. The drawback pump can also be used in automated systems in which a user will activate an automated mechanism to move the piston in a cycle of operation.

A preferred arrangement for operation of the drawback pump in accordance with the present invention is for the pump to assume a position between the condition shown in FIG. 8 and the condition shown in FIG. 5 as a rest position between cycles of operation. For example, in the context of a manual dispenser, the dispenser may be arranged such that the base portion 49 is biased to assume as a rest position between cycles of operation, the extended position seen in FIG. 5. A person would manually operate a lever to move the dispenser from the position of FIG. 5 to the position of FIG. 7. On release of the lever, a spring will return the lever and base portion 48 to the position of FIG. 5. In such a cycle of operation, on movement from the position of FIG. 5 to the position of FIG. 7, fluid is dispensed from the outlet 54. In a return stroke, for example, due to the bias of the spring, fluid in the passageway 54 is withdrawn in movement from the position of FIG. 7 to the position of FIG. 8 and the inner compartment 111 is filled in movement of the piston to the rest position of FIG. 5. In automated operation, a rest position between cycles may be at some point in between the position of FIG. 8 and the position of FIG. 5.

The preferred embodiment illustrates the piston as being formed from a unitary piece of plastic preferably by injection molding. It is to be appreciated that a similar structure could be formed from a plurality of elements, for example, with the variable length portion formed together with at least one of the head portion and the disc portion as a unitary piece of plastic.

In the context of the embodiment of FIGS. 1 to 8, the piston 16 and its variable length portion 45 could have an inherent condition when molded as seen in FIGS. 5 and 8, which is also the condition in which the length L is a maximum. In such an alternate embodiment, FIGS. 1 to 4 represent a partially compressed condition. The members 200 would be molded so as to deflect radially away from each other when the variable length member is compressed, and adopt the bent profile as seen in FIGS. 1 to 4 and FIGS. 6 and 7.

The variable length portion in the preferred embodiments shown in FIGS. 1 to 8 which is injection molded from plastic typically will have an inherent tendency to assume an unbiased condition being the condition of the elongate members 200 forming the variable length portion when they are injection molded. In the embodiment illustrated in FIG. 2, the unbiased condition is a condition shown in FIG. 2 which is intermediate the compressed condition shown in FIG. 5 and the expanded condition shown in FIG. 6. However, it is to be appreciated that the unbiased condition may be any position in between the compressed condition and the expanded condition. A preferred arrangement is for the variable length portion to be inherently biased to assume the expanded condition or at least a condition proximate the expanded condition. This will have, amongst other things, the advantage that the inherent bias of the variable length portion will assist in expanding the volume of the outer compartment 112 to assist in providing drawback and in a rest position of FIG. 5 assist in maintaining the volume of the outer compartment 112 at a maximum.

The embodiment shown in FIG. 2 shows two opposing elongate members 200. While merely two such elongate members 200 are provided, three or more such elongate members could be provided spaced circumferentially about the piston. However, in the context of the piston comprising a unitary element to be injection molded, providing elongate members merely at two oppositely directed sides of the piston can facilitate manufacture by injection molding.

The particular variable length portion may be selected so as to provide the head portion and its head disc maintained coaxially arranged within the chamber. Alternatively, the head disc may be permitted to, at least some extent, tilt or pivot so as to not be coaxially disposed within the chamber and thus provide additional advantages to the invention similar to those provided in pumps with pivoting pivot heads as disclosed in the applicant's U.S. Pat. No. 6,557,736, issued May 6, 2003, the disclosure of which is incorporated herein by reference.

In the embodiment illustrated in FIGS. 1 to 8, when the telescopic section 45 is compressed and the head disc 48 is moved inwardly as, for example, in moving from the position of FIG. 6 to the position of FIG. 7, tilting of the head disc 48 can reduce the resistance to fluid flow past the head disc 48 outwardly. The tilting of the head disc 48 may preferably be sufficient that the edge portion of the head disc 48 becomes displaced from the side wall 20 of the chamber 18 over at least one segment about the circumference of the head disc. In any event, whether or not the tilting is so substantial that the edge portions of the head disc 48 are disposed by tilting alone radially inwardly from the chamber wall 20, to the extent that due to tilting at least some segment the edge portions of the head disc are moved radially inwardly away from the chamber wall 20, the extent to which deflection of the edge portion is required to permit fluid flow outwardly past the head disc 48 is reduced. Tilting of the head disc 48 can assist in pumping fluids containing particulate matter including solid particles such as pumice, sands and other solid particulate matter mixed with liquids to provide a slurry-like composition which is fluid. Tilting may also be of assistance with extremely viscous fluids. Tilting of the head disc 48 may be considered in the first embodiment as an arrangement in which an axis coaxially through the head portion 49 comes to be disposed at an angle relative the chamber axis 22. In the embodiment illustrated in FIG. 2, tilting can occur merely by increased deflection of one of the elongate members 200 compared to the other elongate member 200 as may occur by one of the elongate members 200 having a tendency to deflect under lesser compressive forces than the other elongate member 200. For example, one elongate member 200 could have a reduced cross-sectional area compared to the other elongate member over its length or at one of the living hinges. Such a reduced cross-sectional area could permit one elongate member 200 to compress to a greater extent than the other elongate member yet would not affect, in tension, the elongate members having effectively the same length and thus when in tension providing the head portion 47 and the head disc 48 to be coaxially located in the chamber 18 not tilted to ensure a good seal is formed to prevent movement of fluid inwardly therepast.

While it may be advantageous to have the head disc tilt in some applications on movement of the piston 16 inwardly, on movement of the base portion 49 and the head portion 47 outwardly, it is desired that the head disc be coaxially untilted. In the embodiments illustrated with the head disc 48 extending radially outwardly and axially outwardly on movement of the head disc outwardly, it will tend to assume an untilted configuration.

Figure 9:
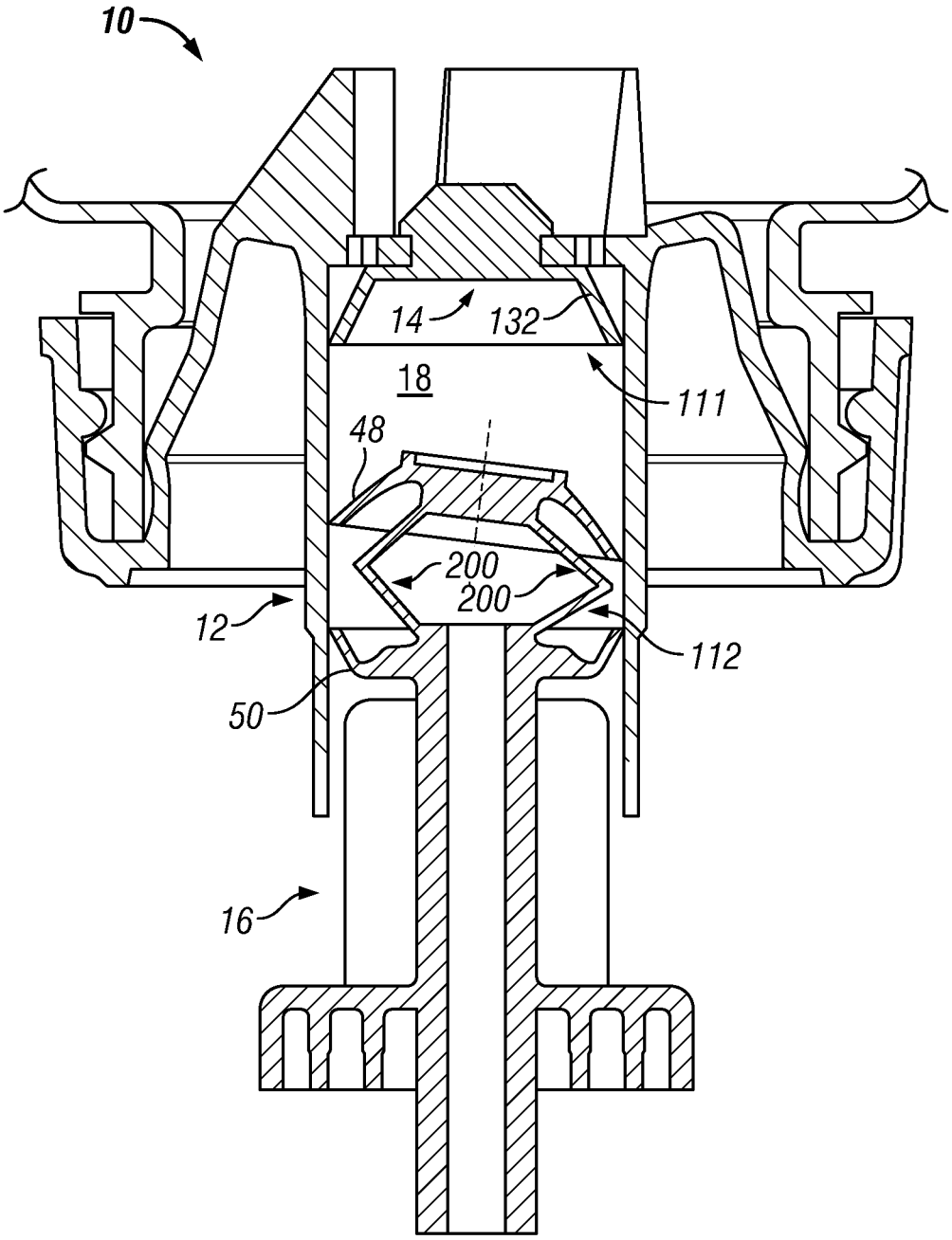
FIGS. 9, 10, 11 and 12 are each a cross-sectional side view of a pump in accordance with respective second, third, fourth and fifth embodiments of the present invention.

Reference is made to FIG. 9 which illustrates in a second embodiment a modified form of a piston 16 as shown in FIGS. 1 to 8 with a left-hand elongate member 200 having an increased thickness compared to the right hand elongate member 200 such that when the piston 16 moves from the position of FIG. 6 to the position of FIG. 7, the head disc 48 assumes a tilted position as shown. In FIG. 9, the stronger left-hand elongate member 200 is shown to not bend so far as to engage the chamber wall 20. Of course, in the embodiment of FIGS. 1 to 8, both elongate members 200 could be provided such that in a compressed condition, the members 200 do not engage the chamber wall 20.

Figure 10:
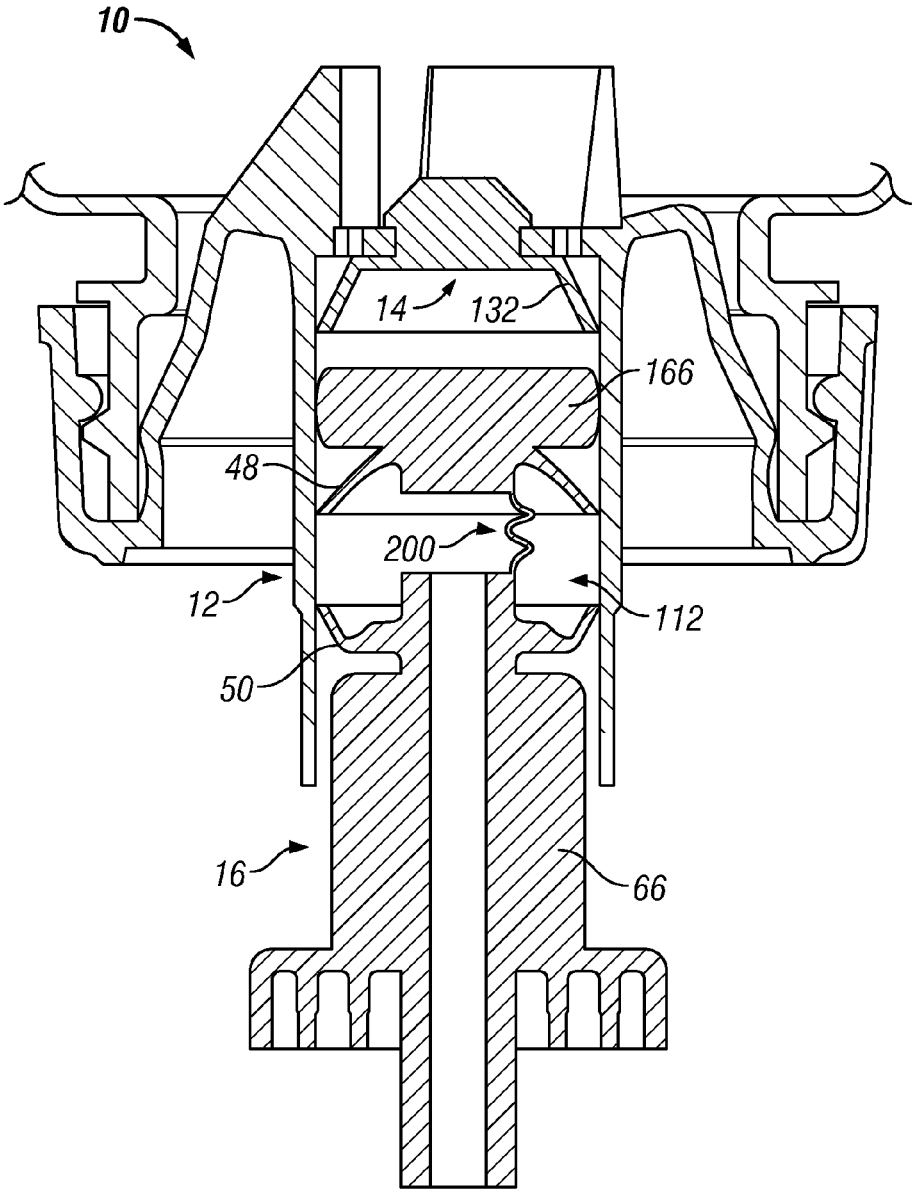

Reference is made to FIG. 10 which shows a third embodiment of a piston element in accordance with the present invention. The embodiment in FIG. 10 differs from the embodiment shown in FIG. 2 in that the head portion 47 includes locating means in the form of a plurality of circumferentially spaced axially extending webs 166 similar to webs 66 to assist in maintaining the head portion coaxially received within the chamber 18 and the two elongate members 200 are replaced by a single string-like tension member 200 which will substantially totally collapse upon itself and not transfer any compressive forces from the base portion 49 to the head portion 47 yet will, when at its maximum length, have adequate strength to transfer tension forces. The stem 46 on the base portion 49 is shown to have an inner axial extension that will come to engage the stem 46 on the head portion 47 in a totally compressed condition.

Figure 11:
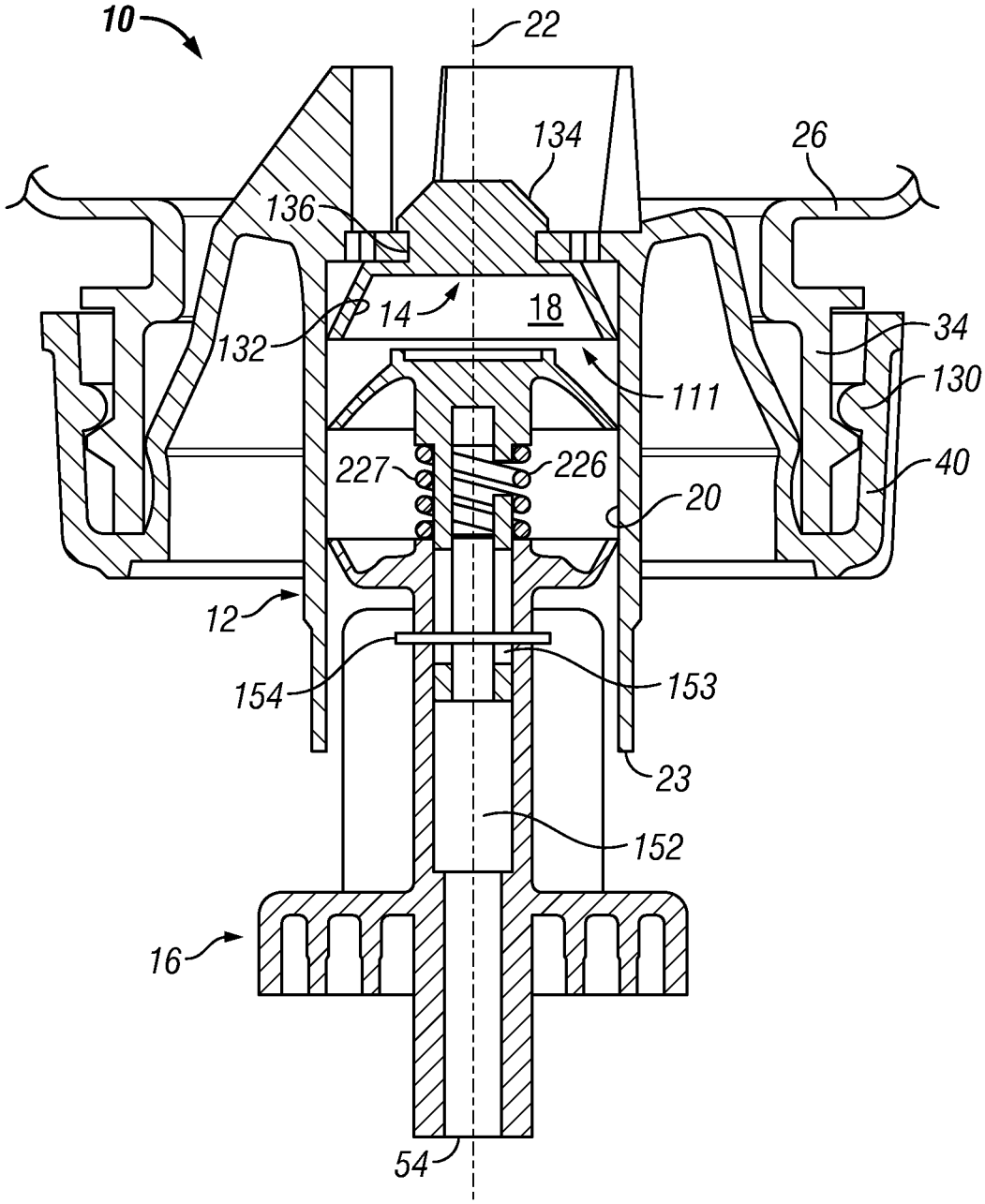

Reference is made to FIG. 11 which shows a fourth embodiment of a piston 16 in accordance with the present invention. In the embodiment of FIG. 11, the stem of the head portion 47 extends axially outwardly with the stem of the head portion 47 telescopically coaxially received in sliding engagement within a cylindrical guide bore 152 in the stem on the base portion 49. The stem 43 on the head portion 47 has slots 153 at diametrically opposed portions of its side wall through which a diametrically extending pin 154 may be provided with the pin fixed at each of its ends in the opposed wall of the stem 46 of the base portion 49 so as to limit the axial extent of relative sliding of the head portion 47 relative the base portion 49 and thus set the maximum length and minimum length of the variable length portion 45. As well, a radial passageway 226 is shown through the stem 43 of the head portion 47 to permit fluid to flow into the passageway 52.

In the embodiments illustrated in FIG. 11, an optional, biasing spring member in the form of a helical coil spring 227 is provided between the head portion 47 and the base portion 49 to bias the head portion 47 and the base portion 49 apart to the expanded condition. The strength of the spring 227 needs to be selected such that it compresses under forces less than the forces required to slide the head portion 47 inwardly.

The preferred embodiment in FIGS. 1 to 8 illustrates a three-piece pump having as the three pieces, the body 12, the one-way valve 14 and the piston 16, and in which the chamber 18 in the body 12 has a constant diameter. The invention of the present application is also adaptable for use with two piece pumps having a stepped chamber. Such pumps have been disclosed in U.S. Pat. No. 5,676,277 to Ophardt, issued Oct. 14, 1997, the disclosure of which is incorporated herein by reference.

Figure 12:
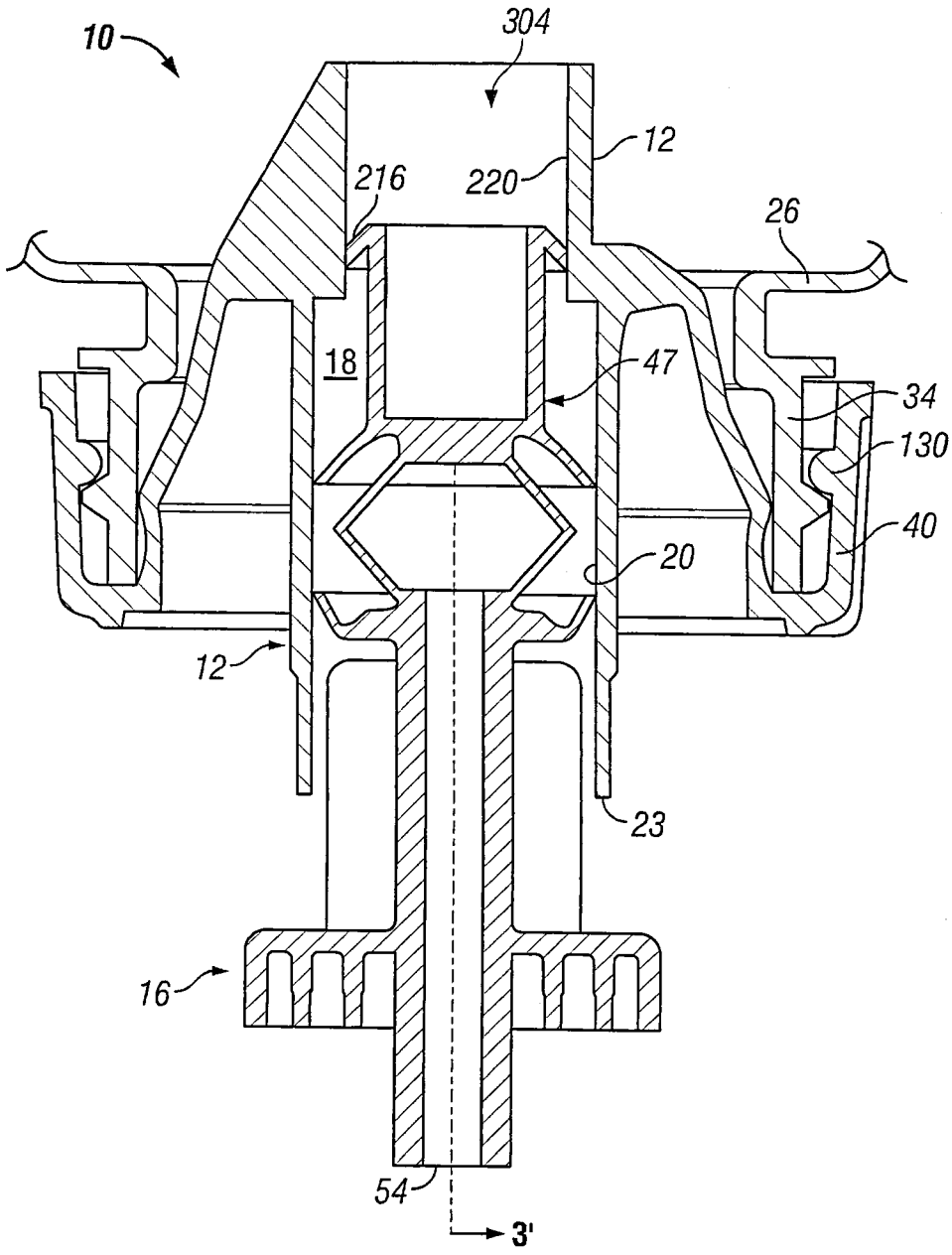

Reference is made to FIG. 12 which shows as a fifth embodiment of the present invention a two piece pump 10 which is substantially the same as the pump of the first embodiment of FIGS. 1 to 8 with the exception that the one way valve 14 of FIG. 1 has been replaced by the provision on the body 12 of a stepped chamber with an inner chamber portion 304 coaxially inward of an outer chamber portion 18 and the provision on the head disc portion 47 of the piston 16 of an innermost disc 216. The inner chamber portion 304 is of a different, smaller diameter than the diameter of the outer chamber portion 18. An outer end of the inner chamber portion opens coaxially into the inner end of the outer chamber portion 18. The innermost disc 216 is formed as a thin resilient disc having an elastically deformable edge portion to engage a chamber wall 220 of the inner chamber portion 304 so as to prevent fluid flow inwardly there past. This deformable edge portion is adapted to deflect radically inwardly away from the chamber wall 220 to permit fluid flow outwardly in the inner chamber portion 304 there past. The arrangement of the stepped cylindrical chamber portions 304 and 18, the innermost disc 216 and the head disc 48 forms a one way valve arrangement in FIG. 12 functionally similar to the one way arrangement in the embodiment of FIGS. 1 to 8. On moving the head disc portion 47 inwardly, fluid in the stepped annular space between innermost disc 216 and head disc 48 is forced outwardly past head disc 48. On moving the head disc portion 47 outwardly fluid is drawn from the container past innermost disc 216 into the stepped annular space between the innermost disc 216 and the head disc 48. The operation of the head disc 48 and the base disc 50 is the same as in the first embodiment of FIGS. 1 to 8.

While the invention has been described with reference to preferred embodiments, many modifications and variations will now occur to persons skilled in the art. For a definition of the invention, reference is made to the following claims.

We claim:

1. A pump for dispensing fluids from a reservoir, comprising:

a piston chamber-forming member having an elongate chamber, said chamber having a chamber wall, an outer open end and an inner end in communication with the reservoir;

a one-way valve between the reservoir and the chamber permitting fluid flow through the inner end of the chamber, only from the reservoir to the chamber;

a piston-forming element slidably received in the chamber extending outwardly from the open end thereof;

the piston-forming element having an inner head portion, an outer base portion and a variable length portion intermediate the head portion and the base portion joining the head portion and the base portion, a head disc extending radially outwardly from the head portion, the head disc having an edge portion proximate the chamber wall circumferentially thereabout, the edge portion of the head disc engaging the chamber wall circumferentially thereabout to substantially prevent fluid flow in the chamber past the head disc in an inward direction, the head disc elastically deforming away from the chamber wall to permit fluid flow in the chamber past the head disc in an outward direction, the base portion having a central axially extending hollow stem having a central passageway open at an outer end forming an outlet, a base disc extending radially outwardly from the stem of the base portion axially outwardly from the head disc, the base disc having an edge portion proximate the chamber wall circumferentially thereabout, the edge portion of the base disc engaging the chamber wall circumferentially thereabout to substantially prevent fluid flow in the chamber past the base disc in an inward direction, the passageway extending from the outlet inwardly to an inner end open to the chamber between the head disc and the base disc, the variable length portion having an axial length measured between the head disc and the base disc which is variable between a maximum length and a minimum length, wherein when the variable length portion has the maximum length the variable length portion is in an expanded condition and when the variable length portion has the minimum length the variable length portion is in a compressed condition, the piston-forming element received in the piston chamber-forming member reciprocally coaxially-slidable inwardly and outwardly by movement of the base portion in the chamber between a retracted position and an extended position in a cycle of operation to draw fluid from the reservoir and dispense it from the outlet, wherein in movement of the base portion inwardly in the chamber while the length of the variable length portion is greater than the minimum length, resistance to movement of the head disc inwardly in the chamber is sufficient that the length of the variable length portion decreases toward the minimum length before the head portion is substantially moved inwardly in the chamber, in movement of the base portion outwardly in the chamber while the length of the variable length portion is less than the maximum length, resistance to movement of the head disc outwardly in the chamber is sufficient that the length of the variable length portion increases toward the maximum length before the head portion is substantially moved outwardly in the chamber, and movement of the base portion outwardly in the chamber while the length of the variable length portion increases toward the maximum length draws fluid in the passageway back into the chamber;

the chamber is coaxially disposed about a chamber axis with the chamber wall substantially circular in any cross section normal to the axis;

the variable length portion comprises an elongate member coupled at an outer end to the base portion and at an inner end to the head portion, the elongate member transmitting axially directed tension force applied thereto by the base portion from the base portion to the head portion, the elongate member reducing in length axially between the base portion and the head portion when axially directed compression forces are applied to the elongate member by the base portion;

the elongate member comprises a resilient member having an inherent bias to assume an unbiased configuration having an unbiased length measured alone the chamber axis equal to or less than the maximum length, the resilient member resiliently deflectable to biased configurations each having a length equal to or less than the maximum length, the inherent bias of the resilient member biasing the resilient member to return towards the unbiased configuration from any one of the biased configurations.

2. A pump as claimed in claim 1 wherein in the cycle of operation the piston-forming element moving:

(a) in a extension stroke:

i. from a first configuration in which the base portion is in the retracted position, the variable length portion in a compressed condition and the head portion in an inner position, ii. to a second configuration in which the head portion is in the inner position, the variable length portion in the expanded condition and the base portion is displaced outwardly from the retracted position toward the extended position, iii. to a third configuration in which the base portion is in the extended position, the variable length portion in the expanded condition and the head portion is in an outer position displaced outwardly from the inner position, and then (b) in a retraction stroke:

iv. from the third configuration to a fourth configuration in which the base portion is displaced inwardly from its extended position, the variable length portion in the compressed condition and the head portion is in the outer position, v. to the first configuration, whereby in movement from the first configuration to the second configuration, the length of the variable length portion substantially increases to the maximum length and fluid in the passageway is drawn back into the chamber.

3. A pump as claimed in claim 2 wherein the chamber is substantially cylindrical in cross-section and the chamber is of a substantially constant diameter.

4. A pump as claimed in claim 3 wherein the head disc and base disc are circular in cross-section and disposed coaxially within the chamber about the chamber axis, the axial length of the variable length portion is measured along the chamber axis from a center of the head disc on the chamber axis to a center of the base disc.

5. A pump as claimed in claim 1 wherein the chamber is substantially cylindrical in cross-section and the chamber is of a substantially constant diameter.

6. A pump as claimed in claim 1 wherein in movement of the base portion inwardly in the chamber while the length of the variable length portion is greater than the minimum length, resistance to movement of the head disc inwardly in the chamber is sufficient that the length of the variable length portion decreases substantially to the minimum length before the head portion is substantially moved inwardly in the chamber, in movement of the base portion outwardly in the chamber while the length of the variable length portion is less than the maximum length, resistance to movement of the head disc outwardly in the chamber is sufficient that the length of the variable length portion increases substantially to the maximum length before the head portion is substantially moved outwardly in the chamber.

7. A pump as claimed in claim 1 wherein the head disc and base disc are circular in cross-section and disposed coaxially within the chamber about the chamber axis, the axial length of the variable length portion is measured along the chamber axis from a center of the head disc on the chamber axis to a center of the base disc.

8. A pump as claimed in claim 7 wherein in movement of the base portion inwardly in the chamber while the length of the variable length portion is greater than the minimum length, resistance to movement of the head disc inwardly in the chamber is sufficient that the length of the variable length portion decreases substantially to the minimum length before the head portion is substantially moved inwardly in the chamber, in movement of the base portion outwardly in the chamber while the length of the variable length portion is less than the maximum length, resistance to movement of the head disc outwardly in the chamber is sufficient that the length of the variable length portion increases substantially to the maximum length before the head portion is substantially moved outwardly in the chamber.

9. A pump as claimed in claim 1 wherein the unbiased length is the maximum length.

10. A pump as claimed in claim 1 wherein the elongate member comprises an inner beam member having an inner end and an outer end, and an outer beam member having an inner end and an outer end, the inner end of the inner beam member hingedly connected to the head portion for pivoting about an inner hinge axis normal to the chamber axis, the outer end of the outer beam member hingedly connected to the base portion for pivoting about an outer hinge axis parallel to the inner hinge axis, the outer end of the inner beam member hingedly connected to the inner end of the outer beam member for pivoting about an outer hinge axis parallel to the inner hinge axis.

11. A pump as claimed in claim 10 wherein the variable length member assumes the minimum length when the junction of the outer end of the inner beam member and the inner end of the outer beam member engages the chamber wall.

12. A pump as claimed in claim 10 wherein the variable length member assumes the maximum length when inner hinge axis, the center hinge axis and the outer hinge axis all lie in the same flat plane.

13. A pump as claimed in claim 1 wherein the elongate member comprises two or more elongate bridging arms, each bridging arm having an inner beam member having an inner end and an outer end, and an outer beam member having an inner end and an outer end, the inner end of the inner beam member hingedly connected to the head portion for pivoting about an inner hinge axis normal to the chamber axis, the outer end of the outer beam member hingedly connected to the base portion for pivoting about an outer hinge axis parallel to the inner hinge axis, the outer end of the inner beam member hingedly connected to the inner end of the outer beam member for pivoting about a center hinge axis parallel to the inner hinge axis, the bridging arms arranged symmetrically about the chamber axis circumferentially spaced from each other.

14. A pump as claimed in claim 13 wherein in movement of the base portion inwardly in the chamber while the length of the variable length portion is greater than the minimum length, resistance to movement of the head disc inwardly in the chamber is sufficient that the length of the variable length portion decreases substantially to the minimum length before the head portion is substantially moved inwardly in the chamber, in movement of the base portion outwardly in the chamber while the length of the variable length portion is less than the maximum length, resistance to movement of the head disc outwardly in the chamber is sufficient that the length of the variable length portion increases substantially to the maximum length before the head portion is substantially moved outwardly in the chamber.

15. A pump as claimed in claim 1 wherein at least one group selected from: (a) base portion and the variable length portion, (b) the head portion and variable length portion, and (c) the base portion, the variable length portion and the head portion; are formed as a unitary member by injection molding from plastic.

16. A pump as claimed in claim 1 including locating members on the stem axially outwardly of the head disc extending radially outwardly from the stem to engage the chamber wall and guide the base disc in sliding axially maintaining the base disc centered and coaxially aligned within the chamber.

17. A pump as claimed in claim 1 including a plurality of axially extending locating webs on the stem axially outwardly of the head disc extending radially outwardly from the stem to engage the chamber wall and guide the base disc in sliding axially maintaining the base disc centered and coaxially aligned within the chamber.

18. A pump as claimed in claim 17 including an engagement member on the stem axially outward of the outer open of the chamber-forming element for engagement to move the piston-forming element inwardly and outwardly.

19. A pump as claimed in claim 1 wherein the edge portion of the head disc is elastically deformable and on the head portion sliding inwardly in the chamber, fluid flow is permitted past the head disc in an outward direction by a combination of (a) tilting of the head disc to an angle to the chamber axis and (b) the edge portion of the head disc deforming away from the chamber wall.

20. A pump as claimed in claim 1 wherein the chamber includes an inner cylindrical portion of a first diameter and an outer cylindrical portion of a second diameter different than the first diameter, the head disc and the base disc are located in the outer cylindrical portion of the chamber, the one-way valve comprising a valve disc carried on the head portion axially spaced inwardly from the head disc, the valve disc located in the inner cylindrical portion of the chamber, the valve disc having an edge portion proximate the chamber wall of the chamber in the inner cylindrical portion circumferentially thereabout, the edge portion of the valve disc engaging the chamber wall circumferentially thereabout to substantially prevent fluid flow in the inner cylindrical portion of the chamber past the valve disc in an inward direction, the valve disc elastically deforming away from the chamber wall of the chamber in the inner cylindrical portion to permit fluid flow in the chamber past the valve disc in an outward direction.

* * * * *